US005925280A

United States Patent [19]

Lee

[11] Patent Number: 5,925,280

[45] Date of Patent: Jul. 20, 1999

[54] FUSE HOUSING FOR A MICROWAVE OVEN

[75] Inventor: Jung-Hee Lee, Kyungki-do, Rep. of Korea

[73] Assignee: Samsung Electronics Co., Ltd., Suwon-City, Rep. of Korea

[21] Appl. No.: 08/921,360

[22] Filed: Aug. 29, 1997

[30] Foreign Application Priority Data

Feb. 26, 1997 [KR] Rep. of Korea ..... 97-6044

[51] Int. Cl.[6] ..... H05B 6/66; H01H 85/143

[52] U.S. Cl. ..... 219/723; 219/715; 219/756; 337/205; 337/207

[58] Field of Search ..... 219/723, 715, 219/702, 756; 337/186, 205, 207, 208, 214, 215

[56] References Cited

U.S. PATENT DOCUMENTS 3,665,094 5/1972 Matthews ..... 337/207
3,778,741 12/1973 Schmidt, Jr. ..... 337/207
3,936,787 2/1976 Ranzanigo ..... 337/228
5,150,094 9/1992 Babini ..... 337/214
5,742,221 4/1998 Baeg ..... 337/208

*Primary Examiner*—Philip H. Leung
*Attorney, Agent, or Firm*—Burns, Doane, Swecker & Mathis, L.L.P.

[57] ABSTRACT

A microwave oven comprises a main body, a cooking chamber and an electrical component compartment. The electrical component compartment contains a fuse housing which is mounted on a bracket to hold a fuse. Plastic coupling members are integrally mounted onto the fuse housing bracket, into which a fuse is inserted. Each coupling member includes a guide projecting integrally upwardly from the bracket. Both sides of the fuse housing contact respective ones of the guides. A protruding portion on the top of each guide forms a cam surface for spreading the guides apart, and a stop surface for preventing upward dislodgement of the fuse housing.

1 Claim, 4 Drawing Sheets

FIG. 4A
(PRIOR ART)
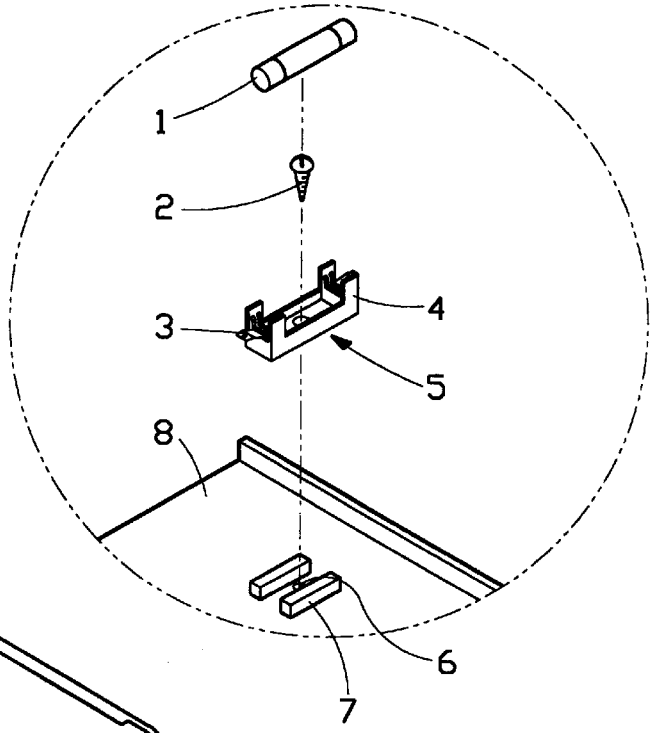
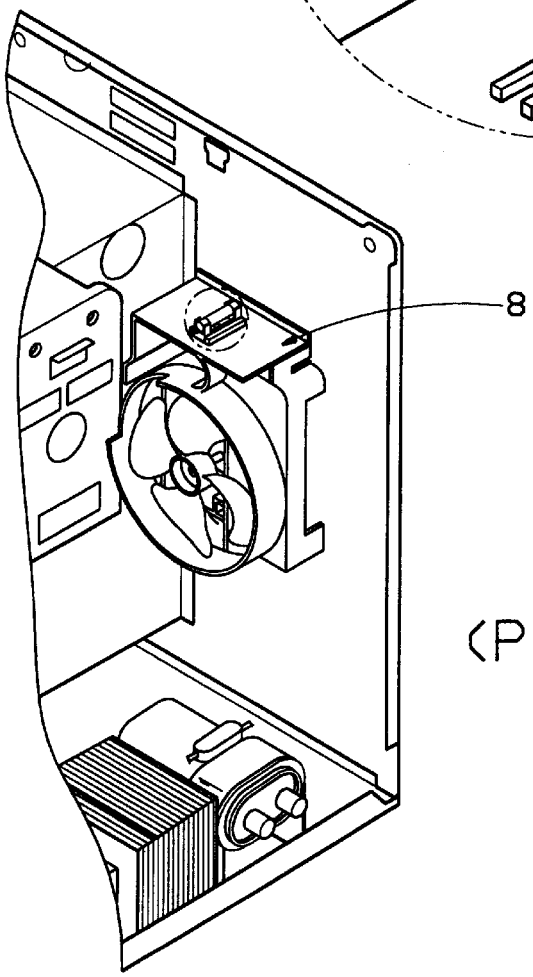
FIG. 4
(PRIOR ART)

FUSE HOUSING FOR A MICROWAVE OVEN

BACKGROUND OF THE INVENTION (1) Field of the Invention

The present invention generally relates to a microwave oven which cooks food using a magnetron. More particularly, it relates to a microwave oven having an improved fuse housing.

(2) Description of the Prior Art

Generally, a microwave oven is a cooking appliance which cooks food by frictional heat produced by making the molecules of the food move at high speeds utilizing high frequency energy. Such a microwave oven has a cooking chamber and an electric component compartment separated from each other within the main body. The main body is formed by an inner case, which forms the cooking chamber, and an outer case that acts as a decorative exterior. A door is hinged at one side of the front of the inner case to open and close the cooking chamber. A control panel having a display and operating buttons is located adjacent to the door.

The electric component compartment is positioned adjacent the cooking chamber and includes an air duct which introduces, into the cooking chamber, air and microwave frequencies produced by a magnetron. A high voltage transformer supplies high voltage to the magnetron, and a fan cools the electrical components during operation. The fan is positioned in a middle portion of a motor bracket, fixed onto the inner side of the rear panel of the electric component compartment.

A fuse, to interrupt excessive current, is seated in a fuse housing fixed on top of the motor bracket as depicted in FIGS. 4 and 4A.

As shown in the drawing, a fuse 1 is held in a fuse housing 5. A pair of rectangular ribs 7 are integrally formed on the top of the motor bracket 8. The ribs 7 are made of plastic by means of an injection molding process. The ribs 7 are spaced from each other by the width of the fuse housing 5. A hole 6 is formed between the ribs 7. At both ends of the fuse housing 5, a terminal 3 is electrically connected to both ends of the fuse 1. A wire (not illustrated) is connected to each of the terminals 3. A coupling opening 4 is formed on the middle of the fuse housing 5, through which a screw 2 passes. The fuse housing 5 is interposed between the ribs 7 in order that the coupling opening 4 aligns with the screw hole 6. When the screw 2 is inserted into the hole 6, passing through the coupling opening 4, it fastens the fuse housing 5 to the top of the motor bracket 8. The ribs 7, contacting both sides of the fuse housing 5, prevent the installed fuse housing 5 from being dislocated. The fuse 1 is then inserted between the terminals 3 of the fuse housing 5, thus completing the coupling of the fuse housing 5.

When replacing a used fuse housing with a new one, the screw 2 needs to be loosened and then tightened after replacement. This lowers the operational efficiency of the unit. In addition, during production, workers are required to individually screw fuse housings to the top of the motor brackets by means of screw drivers. As a result, the number of components and production steps is increased, thus making assembly complicated and lowers production yields. Therefore, overall production costs increase. Since the motor bracket 8 is made of plastic, if the above work is frequently carried out, the screw threads in the hole 6 will strip, making the screw 2 loose. In addition, the fuse housing 5 may be removed from the top of the motor bracket 8 by external vibration or shock, which endangers safe operation.

SUMMARY OF THE INVENTION

The present invention relates to a microwave oven that obviates the defects and disadvantages of the conventional technique.

It is an objective of the present invention to provide a microwave oven in which coupling members, each having a guide and protruding portion, are molded on the top of a motor bracket in equidistantly spaced relationship, and a fuse housing is inserted between the coupling members in such a manner that it elastically flexes the guides apart and becomes caught beneath stop surfaces of the guides, thus providing an enhanced coupling structure for the fuse housing and reducing the number of components to lower production costs.

To obtain the objective of the present invention, the inventive microwave oven has a main body divided into a cooking chamber and an electrical component compartment, and a fuse housing installed on a bracket in the electrical component compartment to hold a fuse. Coupling members are integrally formed on the bracket to receive the fuse housing. Each of the coupling members includes an upward projecting elastic guide formed on the top of the bracket for contacting a respective side of the fuse housing, and a protruding portion formed on the top of each guide to form a cam surface and a stop surface. The cam surfaces enable the guides to be spread apart, and the stop surfaces capture the fuse housing.

BRIEF DESCRIPTION OF THE DRAWINGS

The objects and advantages of the invention will become apparent from the following detailed description of a preferred embodiment thereof in connection with the accompanying drawing in which like numerals designate like elements, and in which:

FIG. 4 is a fragmentary top perspective view of a prior art fuse coupling structure; and FIG. 4A is an exploded perspective view of an encircled portion of the prior art fuse coupling structure of the fuse housing in accordance with the prior art shown in FIG. 4.

DETAILED DESCRIPTION OF A PREFERRED EMBODIMENT OF THE INVENTION

A preferred embodiment of the present invention will be described in detail with reference to the accompanying drawings.

Figure 1:
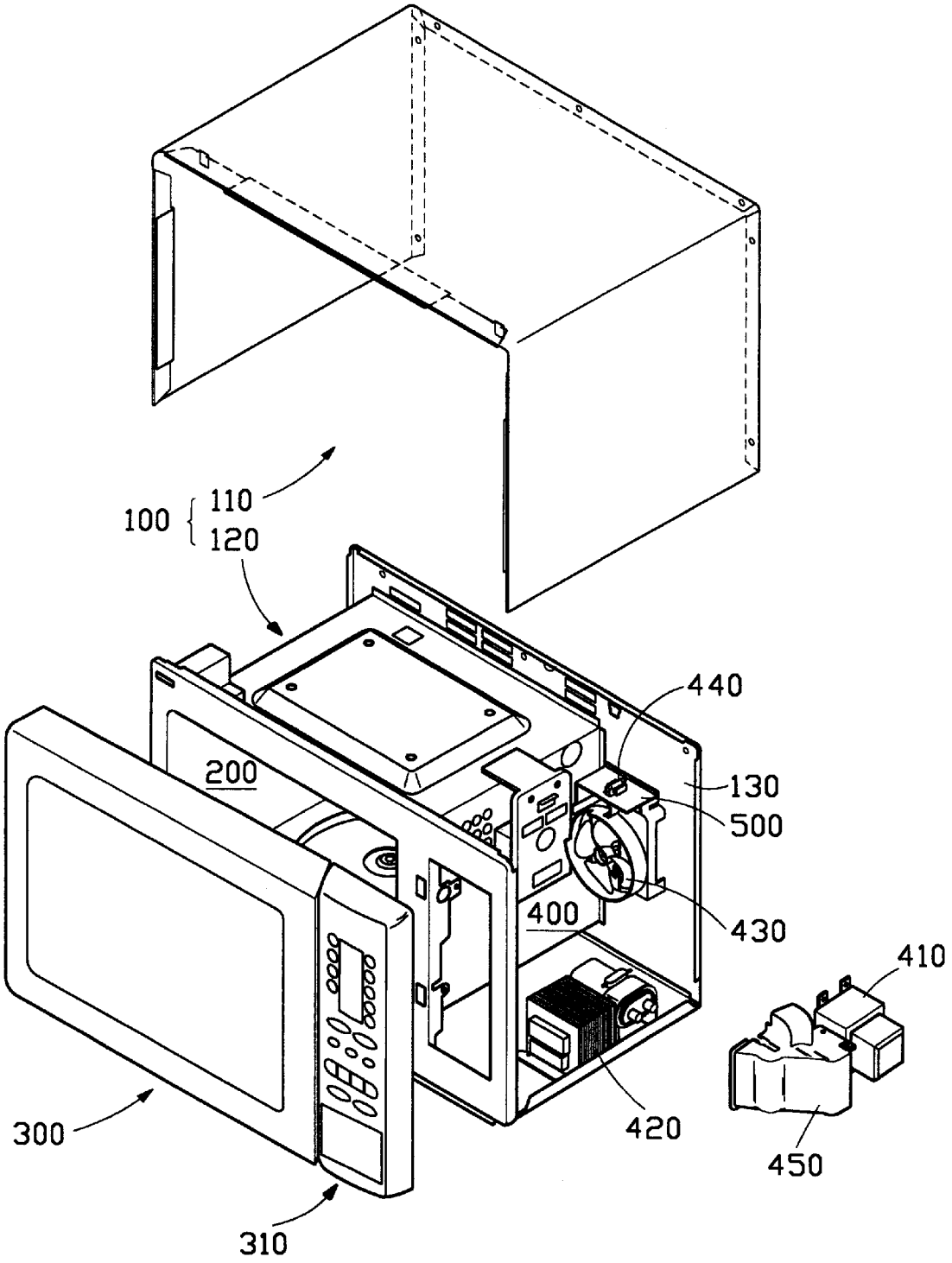
FIG. 1 is an exploded perspective view of the overall structure of the microwave oven in accordance with the present invention.

As shown in FIG. 1, a microwave oven of the present invention has a main body 100 in which a cooking chamber 200 and an electrical component compartment 400 are provided. The main body 100 includes an inner case 120 in which the cooking chamber 200 with an open side is formed, and an outer case 110 which is coupled to the inner case 200. The electrical component compartment 400 is separated from the cooking chamber 200. A door 300 is hinged on one side of the front of the main body 100 to open and close the cooking chamber 300. A control panel 310, with operating buttons (not illustrated) and a display (not illustrated), is also located on the front of the main body 100.

The electrical component compartment 400 houses a magnetron 410 to generate microwave frequencies for the cooking chamber 200. A high voltage transformer 420 and a fan 430 for cooling heat emitting are also housed in the electrical component compartment 400. The fan 430 is located in the middle of a motor bracket 500. The motor bracket 500 is formed of molded plastic and secured to a ventilated rear panel 130. A guide duct 450 is provided to introduce air into the cooking chamber 200.

Figure 2:
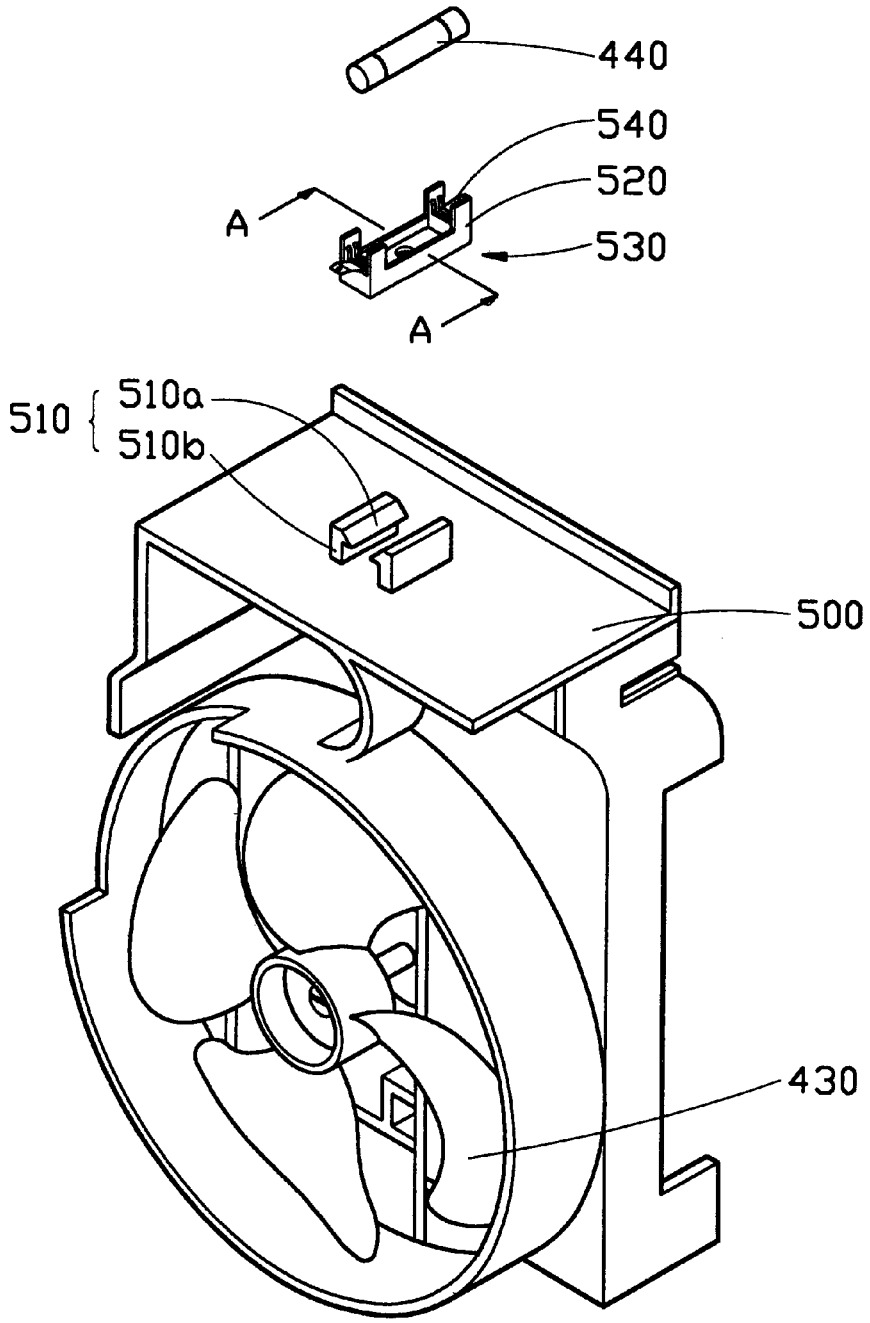
FIG. 2 is an exploded perspective view showing the coupling structure of the fuse housing in accordance with the present invention.
Figure 3:
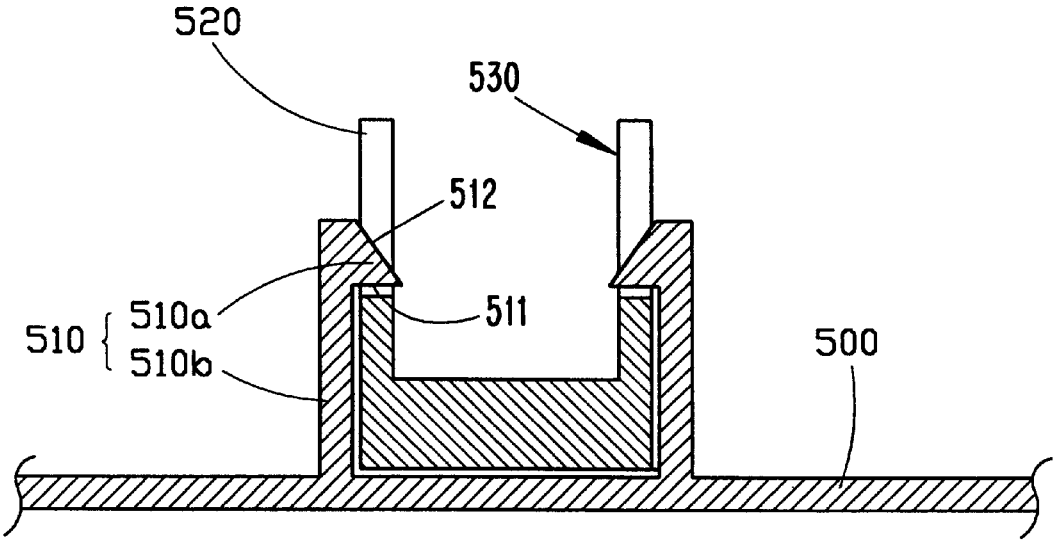
FIG. 3 is a cross-sectional view taken along line A—A of FIG. 2, showing the coupling structure of the fuse housing.

A fuse housing 530 and a fuse 440, that serves to interrupt excessive current, are mounted on the top of the motor bracket 500. The fuse housing 530 is inserted between a pair of coupling members 510. A detailed description of the coupling members 510 follows with reference to FIGS. 2 and 3.

The fuse housing 530 is a quadrilateral body with a specified length. On both ends of the fuse housing 530 are formed terminals 540, which are electrically connected to the fuse 440. A fixing portion 520 is formed to the right and left sides of the upward protruding fuse housing 530. This allows installation of the terminals 540 on each fixing portion, to which a wire (not illustrated) is connected.

To firmly hold the fuse housing 530, a pair of upwardly protruding coupling members 510 are formed on the top of the motor bracket 500. Each coupling member 510 is comprised of a guide 510*b* protruding upwardly from the top of the motor bracket 500. The guides are parallel and spaced apart to form a receiving space between one another and to hold both sides of the fuse housing 530. An inwardly protruding portion 510*a* is formed on the top of each guide 510*b* to overlie and retain the upper portion of the fuse housing 530 when inserted by snap action between the coupling members 510. The underside 511 of the protruding portion 510*a* faces the receiving space and forms a right angle with the guide 510*b*, and the guides 510*b* are equidistantly spaced from each other enough to insert the fuse housing 530. The top side 512 of each protruding portion faces away from the receiving space and is slanted so that the two top sides are downwardly convergent and define cam surfaces. To provide elasticity, the protruding portion 510*a* and the guide 510*b* are formed as integral components of the motor bracket 500 by means of injection-molded plastic.

When the fuse housing 530 is inserted between the coupling members 510, the force of the fuse housing pressing against the top sides 512 causes the coupling members to flex away from one another, enabling the fuse housing to travel downwardly into the receiving space between the guides 510*b* which thus enclose the fuse housing 530. The undersides 511 of the protruding portions 510*a* define stop surfaces which overlie the upper portion of the fuse housing 530, whereby the fuse housing 530 is fixed to the top of the motor bracket 500. At this state, both ends of the fuse 440 are connected to the terminals 540.

The fuse housing 530 may slightly shift forward and backward. When it does so, the protruding portions 510*a* abut stop surfaces defined by the fixing portions 520 of the fuse housing 530. Thus the fuse housing 530 cannot be dislocated without applying intentional force. When replacing the fuse housing 530 with a new one, the guides 510*b* are spread apart. The fuse housing 530 can then be removed upwardly.

According to the present invention, the fuse housing 530 can be easily fastened to and removed from the injection-molded coupling members 510. This enhances the output of the production line, and facilitates the replacement of the fuse housing 530.

As fully described above, the inventive microwave oven includes the improved coupling members. Each coupling member has a guide and a protruding portion that are spaced away from each other on the top of the motor bracket for receiving the fuse housing therebetween. The guides of the molded plastic coupling members catch the fuse housing and prevent it from being dislocated. By such a structure, the fuse housing can be easily fastened or removed to the top of the motor bracket, thereby decreasing the number of components and lowering the production costs.

Although the present invention has been described in connection with a preferred embodiment thereof, it will be appreciated by those skilled in the art that additions, modifications, substitutions and deletions not specifically described may be made without departing from the spirit and scope of the invention as defined in the appended claims.

What is claimed is:

1. A microwave oven comprising a main body forming a cooking chamber and an electrical component compartment; a bracket arranged inside of the electrical component compartment, the bracket including a pair of coupling members; and a fuse housing releasably retained by the coupling members; each coupling member including an elastic guide formed of one piece with the guide and projecting outwardly therefrom, the guides arranged parallel to one another and spaced apart to form a receiving space, each guide including a protuberance at an outer end thereof, each protuberance including a stop surface facing the receiving space, and a cam surface facing away from the receiving space, the cam surfaces being slanted and converging toward one another in a direction toward the receiving space for enabling the guides to be elastically flexed away from one another; the stop surfaces overlying the fuse housing to prevent dislodgement thereof.

* * * * *